US010309182B2

(12) United States Patent
Jones et al.

(10) Patent No.: US 10,309,182 B2
(45) Date of Patent: Jun. 4, 2019

(54) ANNULAR BLOWOUT PREVENTER APPARATUS

(71) Applicant: Cameron International Corporation, Houston, TX (US)

(72) Inventors: Oscar B. Jones, Houston, TX (US); Nicolas Arteaga, Jersey Village, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/220,082

(22) Filed: Jul. 26, 2016

(65) Prior Publication Data

US 2018/0030803 A1 Feb. 1, 2018

(51) Int. Cl.
*E21B 33/06* (2006.01)
*E21B 33/064* (2006.01)

(52) U.S. Cl.
CPC ..... *E21B 33/064* (2013.01); *E21B 33/06* (2013.01)

(58) Field of Classification Search
CPC ..... E21B 33/61; E21B 33/064; E21B 33/06
USPC ..... 251/1.1, 1.2; 166/363
See application file for complete search history.

(56) References Cited

U.S. PATENT DOCUMENTS 1,464,396 A * 8/1923 Rowland ..... E21B 33/04 137/613
1,800,694 A * 4/1931 Melott ..... E21B 33/06 251/1.1
1,872,105 A * 8/1932 Black ..... E21B 33/06 166/84.1
2,832,617 A * 4/1958 Gibson ..... E21B 33/06 277/327
2,846,178 A * 8/1958 Minor ..... E21B 33/06 166/80.1
3,897,040 A * 7/1975 Le Rouax ..... E21B 33/06 166/84.4
4,626,135 A * 12/1986 Roche ..... E21B 21/001 166/84.4
4,718,495 A * 1/1988 Lubitz ..... E21B 33/02 166/120

(Continued)

FOREIGN PATENT DOCUMENTS

WO 2014/100363 A2 6/2014

OTHER PUBLICATIONS

International Search Report and Written Opinion for the equivalent International patent application PCT/US2017/043928 dated Oct. 25, 2017.

(Continued)

*Primary Examiner* — Umashankar Venkatesan
(74) *Attorney, Agent, or Firm* — Helene Raybaud

(57) ABSTRACT

The present disclosure generally relates to an annular blowout preventer ("BOP") apparatus for sealing a wellbore. In particular, the annular BOP includes a body comprising a vertical bore extending therethrough, an upper packing element located in the body, a lower packing element located in the body and spaced axially from the upper packing element, and a piston configured to move the upper and lower packing elements radially with respect to the vertical bore. The annular BOP provides for bi-directional sealing across the annular BOP. In other embodiments, the annular BOP may include only a single packing element configured to provide for bi-directional sealing across the annular BOP.

18 Claims, 9 Drawing Sheets

(56) References Cited

U.S. PATENT DOCUMENTS

| | | | | |
|---|---|---|---|---|
| 4,949,785 | A * | 8/1990 | Beard | E21B 33/06 166/196 |
| 8,176,933 | B2 * | 5/2012 | Huff | B29C 35/0222 137/315.02 |
| 8,967,589 | B2 * | 3/2015 | Wood | E21B 33/062 251/1.1 |
| 2013/0168578 | A1 | 7/2013 | Leuchtenberg et al. | |
| 2014/0048731 | A1 | 2/2014 | Leuchtenberg et al. | |
| 2016/0201422 | A1 | 7/2016 | Averill et al. | |

OTHER PUBLICATIONS

International Preliminary Report on Patentability for the equivalent International patent application PCT/US2017/043928 (032562-WO-PCT) dated Feb. 7, 2019.

* cited by examiner

ANNULAR BLOWOUT PREVENTER APPARATUS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Drilling and production operations for the recovery of offshore deposits of crude oil and natural gas are taking place in deeper and deeper waters. Drilling and production operations in deeper waters are typically carried out from floating vessels rather than from stationary platforms resting on the ocean floor and commonly used in shallow water. According to conventional procedures, a vessel is dynamically stationed, or moored, above a well site on the ocean floor. After a wellhead has been established, a blowout preventer ("BOP") stack including one or more BOPs is mounted on the wellhead to control the pressure in the wellhead.

Typical BOPs are used as a large specialized valve or similar mechanical device that seal, control, and monitor oil and gas wells. The two most common categories of BOPs are rain BOPs and annular BOPs. BOP stacks frequently utilize both types of BOPs, typically with at least one annular BOP stacked above several rain BOPs. The annular unit or units allow for sealing off an annulus between a tubular in the BOP bore (e.g., drill pipe) or on an open hole. The rain units in rain BOPs allow for shearing drill pipe in the case of shear rams, sealing off around drill pipe in the case of pipe rains, and sealing the BOP bore in the case of blind rams. Typically, a BOP stack may be secured to a wellhead and may provide a safe means for sealing the well in the event of a system failure.

FIG. 1 shows a prior art annular BOP 100. Annular BOP 100 comprises a vertical bore 102 extending through a housing 104 and disposed about a longitudinal axis 106. A packing element 108 is disposed within the annular BOP 100 about the longitudinal axis 106. The packing element 108 includes an annular elastomeric body 110 and a plurality of inserts 112. The inserts 112 are distributed radially about the longitudinal axis 106. The packing element 108 includes a bore 114 concentric with the vertical bore 102 of the annular BOP 100.

The annular BOP 100 is actuated by pumping a fluid into a close chamber 116 to apply pressure to a piston 118, thereby moving the piston 118 upward. As the piston 118 moves upward, the piston translates force to the packing element 108. The force translated to the packing element 108 from the piston 118 is directed upward toward an inner surface 120 of the annular BOP 100 and inward toward the longitudinal axis 106 of the annular BOP 100.

Because the packing element 108 is retained against the inner surface 120 of the annular BOP 100, the packing element 108 does not displace upward from the force translated by the piston 118. Rather, the packing element 108 displaces inward from the translated force, which compresses the packing element 108 toward the longitudinal axis 106 of the annular BOP 100. In the event a drill pipe is located within the annular BOP 100, with sufficient radial compression, the packing element 108 will seal about the drill pipe into a closed position. In the event a drill pipe is not present, the packing element 108, with sufficient radial compression, will completely seal the bore 102.

The annular BOP 100 goes through an analogous reverse movement when fluid is pumped into an open chamber 122. The fluid translates downward force to the piston 118, such that the piston allows the packing element to radially expand to an open position. The annular BOP 100 can be cycled between the open and closed positions as necessary.

When run into the closed position, the annular BOP 100 seals off only on the pressure below the annular BOP 100 by creating a sealing point around the elastomeric body 110 of the packing element 108. Because of the geometry of the annular BOP 100 and its packing element 108 as well as the distribution of inserts 112 about the packing element 108, the annular BOP 100 is not able to seal off pressure from above the annular BOP 100. That is, pressure from above the annular BOP 100 can access the elastomeric body 110 of the packing element 108, thereby causing it to extrude. To overcome this problem, operators may include a plurality of annular BOPs in a single BOP stack to ensure sealing above and below the BOP stack. However, inclusion of additional annular BOPs, including additional housings, packing elements, pistons, etc., adds undesirable height to the BOP and is costly.

Accordingly, an annular BOP capable of sealing off pressure from above and below the annular BOP is desirable.

DESCRIPTION OF THE DRAWINGS

For a more detailed description of the embodiments, reference will now be made to the following accompanying drawings.

DETAILED DESCRIPTION OF THE EMBODIMENTS

Figure 1:
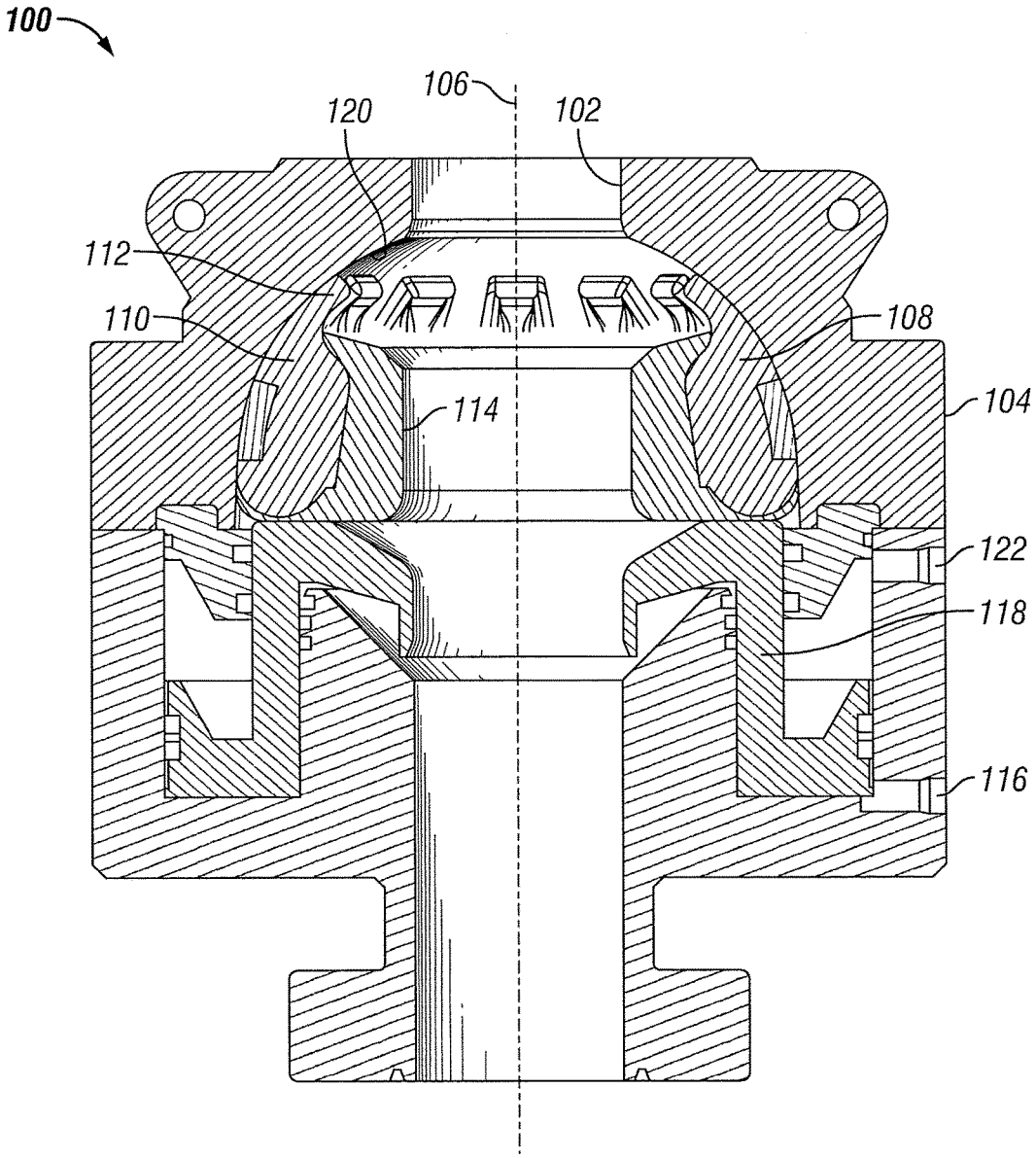
FIG. 1 (Prior Art)
FIG. 1 shows a partial cross-sectional elevational view of a prior art annular blowout preventer.
Figure 2:
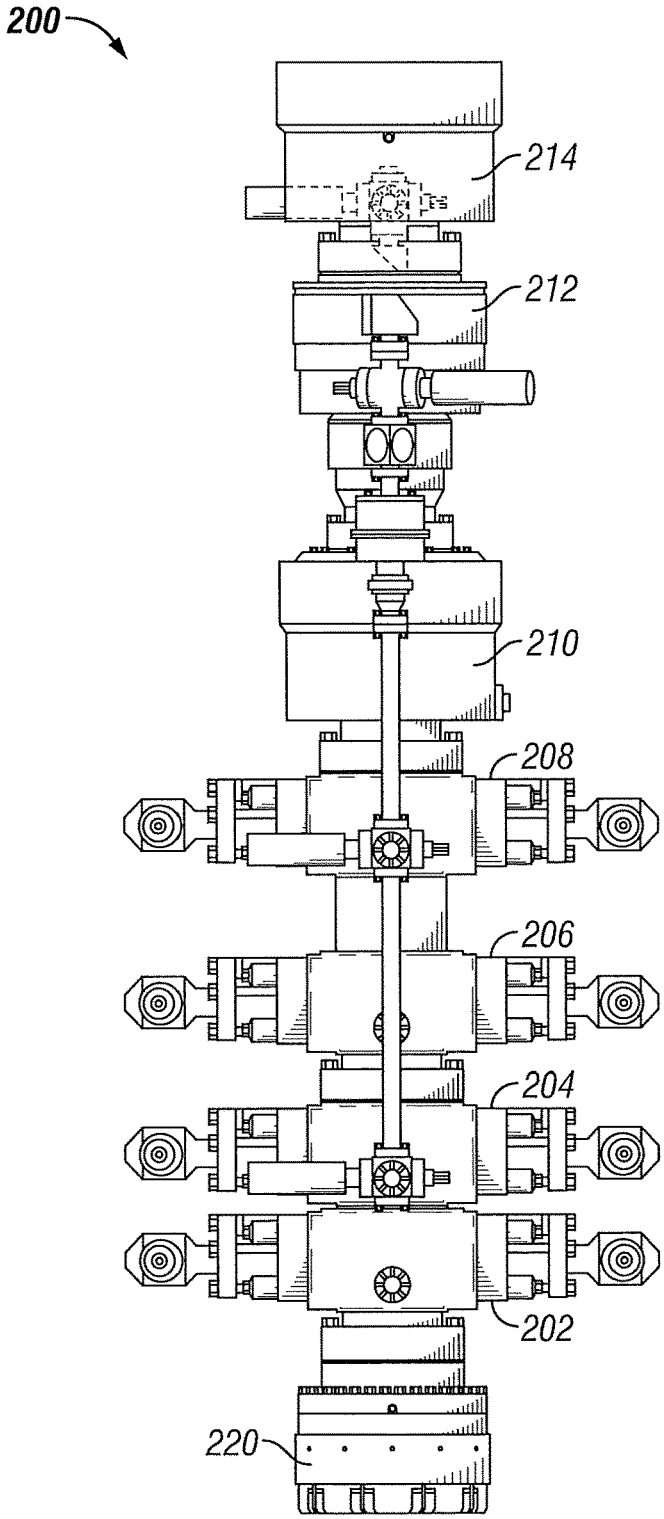
FIG. 2 shows a side elevation view of a subsea blowout preventer stack.
Figure 3:
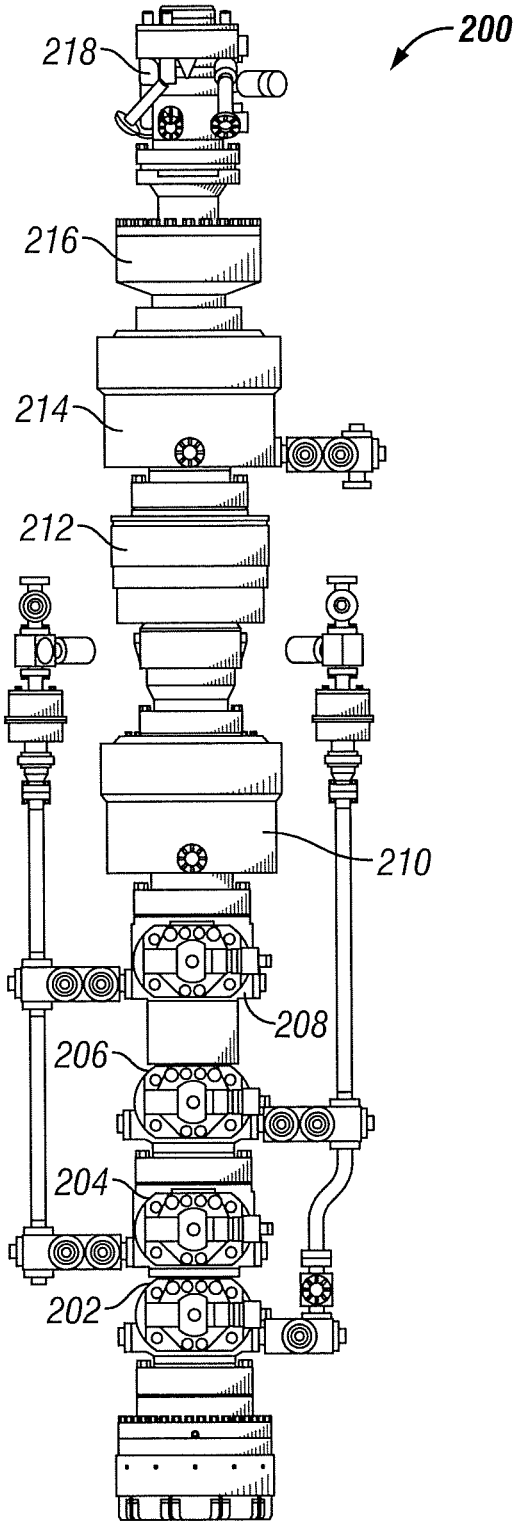
FIG. 3 shows another side elevation view of the subsea blowout preventer stack of FIG. 2.

FIGS. 2 and 3 provide two views of a subsea BOP stack shown generally at 200. Various hydraulic lines, framework and control apparatuses for operating the BOP stack 200 are not shown for purposes of clarity. The stack 200 includes four rain-type BOPs 202, 204, 206 and 208 including various types of ram assemblies configured to close in on and central bore of the BOP stack 200. An annular BOP 210, a connector 212, a second annular BOP 214 and a flex joint 216 are arrayed above the ram-type BOPs 202-208. One or both of annular BOPs 210 and 214 can be located on the BOP stack, as shown. Alternatively, one or both of the annular BOPs 210 and 214 may be located on a lower marine riser package ("LMRP") positioned above and in fluid communication with the BOP stack 100. When using an annular BOP according to the present disclosure, the second annular BOP 214 can be eliminated from the BOP stack. A riser adapter 218 is positioned at the top of the stack 200 for connection to a LMRP (not shown). A wellhead connector 220 is located at the bottom of the stack 200 for connection to a high pressure wellhead housing below (not shown). In general, the number and kind of BOPs in a stack, as well as the order in which they are arrayed in the stack, may vary depending on the needs of the end user.

Figure 4:
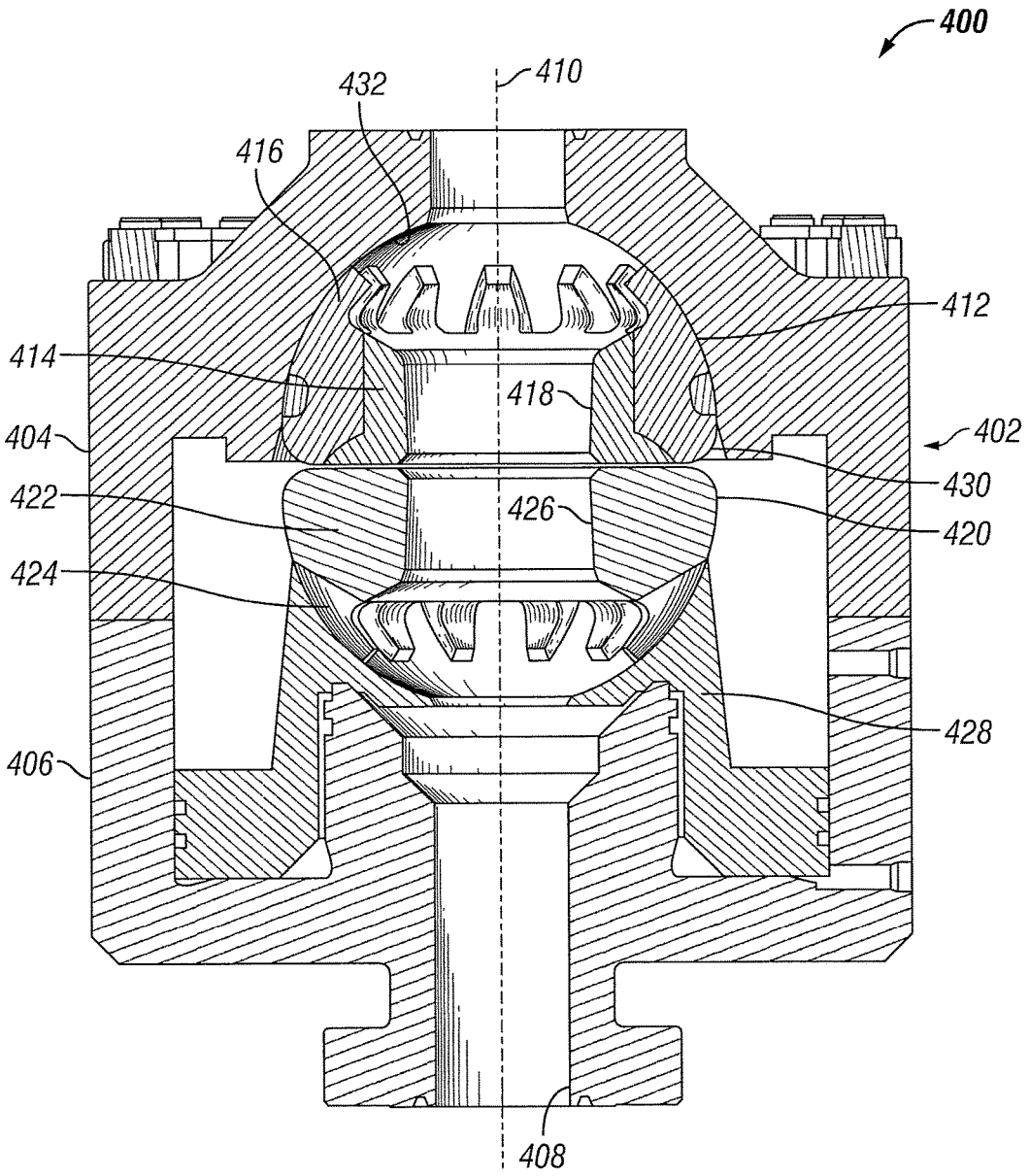
FIG. 4 shows a partial cross-sectional elevation view of an annular blowout preventer in an open position, in accordance with one or more embodiments.

FIG. 4 shows a partial cross-sectional elevation view of an annular BOP 400 in an open position, in accordance with one or more embodiments. The annular BOP 400 could be included in a subsea BOP stack, such as BOP stack 200 illustrated in FIGS. 2 and 3. The annular BOP 400 comprises a housing 402 including an upper or first housing 404 and a lower or second housing 406. The housing 402 includes a vertical bore 408 extending therethrough and disposed about a longitudinal axis 410. An upper or first packing element 412 is disposed within the housing 402 about the longitudinal axis 410. The upper packing element 412 includes an annular elastomeric body 414 and a plurality of inserts 416. The inserts 416 are distributed radially about the longitudinal axis 410. The upper packing element 412 includes a bore 418 concentric with the vertical bore 408 of the annular BOP 400.

The housing 402 further includes a lower or second packing element 420 disposed about the longitudinal axis 410. An annular wear plate 430 is located between the upper and lower packing elements 412 and 420. The lower packing element 420 includes an annular elastomeric body 422 and a plurality of inserts 424. The inserts 424 are distributed radially about the longitudinal axis 410. The lower packing element 420 includes a bore 426 concentric with the vertical bore 408 of the annular BOP 400 and of a similar diameter to upper packer element bore 418.

The upper and lower inserts 416 and 424 can comprise any material or materials suitable for use in an annular blowout preventer, such as metal and/or metal alloys. The elastomeric bodies 414 and 422 can comprise any elastomeric material or materials. The annular wear plate 430 can comprise any material or materials suitable for the upper and lower inserts 416 and 424, such as metal and/or metal alloys. In the illustrated embodiment, packing elements 412 and 420 comprise hemispherical geometries. However, other geometries are envisioned, as will be discussed further below.

The annular BOP 400 upper and lower packing elements 412 and 420 are actuated by pumping a fluid into a close chamber (not shown) to apply pressure to a piston 428, thereby moving the piston 428 upward. The piston 428 has a complimentary hemispherical geometry to that of the lower packing element 420. As the piston 428 moves upward, the piston 428 translates force directly to the lower packing element 420 and indirectly to annular wear plate 430 and upper packing element 412. The force translated to the lower packing element 420, annular wear plate 430, and upper packing element 412 from the piston 428 is directed upward toward an inner surface 432 of the annular BOP 400 housing 402, and inward toward the longitudinal axis 410 of the annular BOP 400.

Because the upper packing element 412 is retained against the inner surface 432 of the annular BOP 400 housing 402, the upper packing element 412, annular wear plate 430, and lower packing element 420 do not displace upward from the force translated by the piston 428. Rather, the upper and lower packing elements 412 and 420 push off annular wear plate 430 and displace inward from the translated force, which compresses the upper and lower packing elements 412 and 420 toward the longitudinal axis 410 of the annular BOP 400. Accordingly, in one or more embodiments, the annular BOP 400 may be configured to seal off a well, including sealing off pressure from above and below the annular BOP 400. Specifically, the annular BOP 400, as shown in FIG. 4, can be configured into a closed position to seal off the well without the presence of a pipe or other downhole equipment disposed within the annular BOP 400, i.e., sealing an open hole. In the event a drill pipe (as shown in FIG. 5) is located within the annular BOP 400, with sufficient radial compression, the upper and lower packing elements 412 and 420 will seal about the drill pipe into a closed position.

Figure 5:
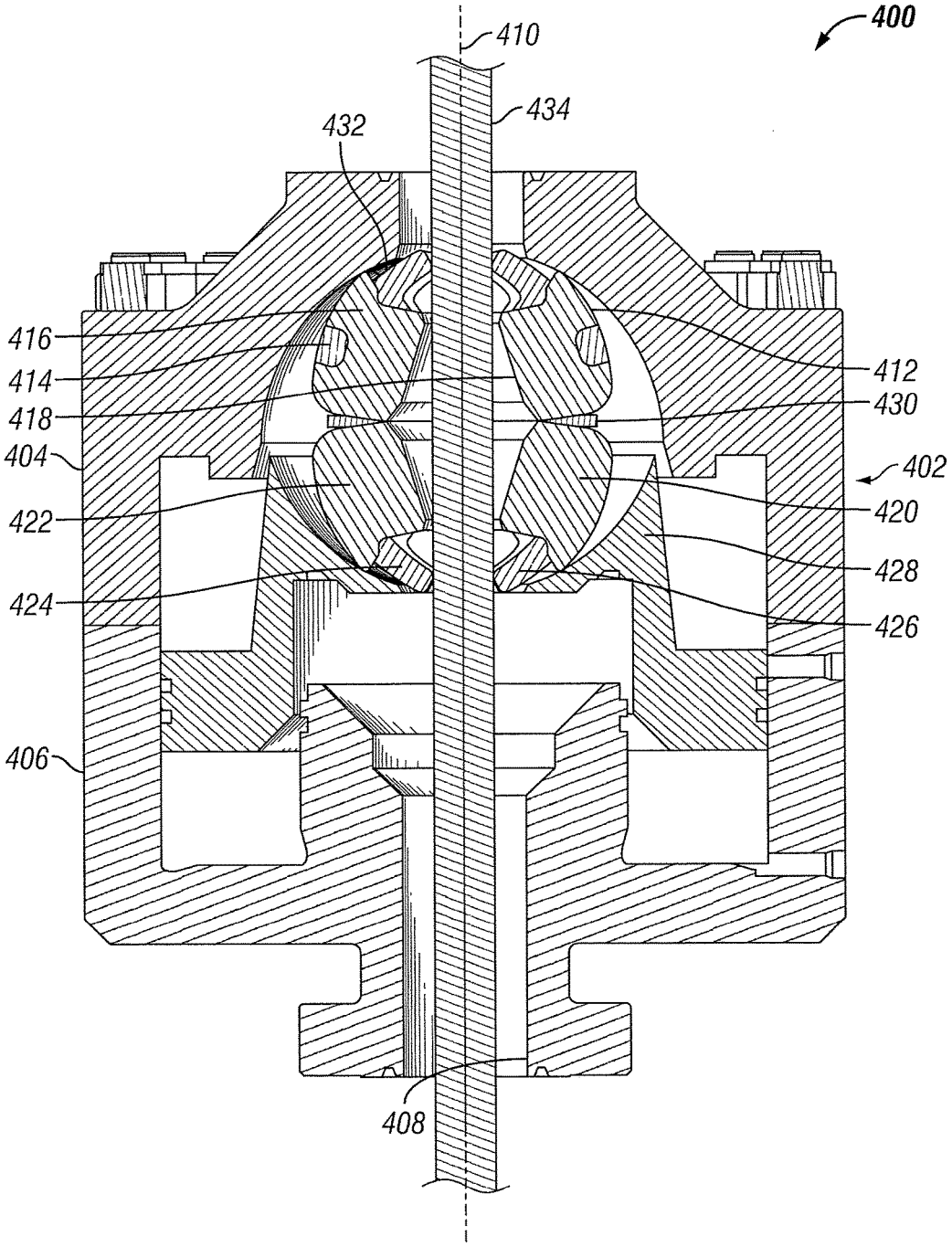
FIG. 5 shows a partial cross-sectional elevation view of the annular blowout preventer of FIG. 4 in a closed position, in accordance with one or more embodiments.

FIG. 5 shows a partial cross-sectional elevation view of the annular BOP 400 of FIG. 4 in the closed position, in accordance with one or more embodiments. In particular, the piston 428 in FIG. 5 has moved upward as discussed above. In doing so, the piston 428 has displaced upper and lower packing elements 412 and 420 toward the longitudinal axis 410 of the annular BOP 400, thereby allowing for bi-directional sealing functionality. That is, inclusion of upper and lower packing elements 412 and 420 provides for sealing pressure from above and below the annular BOP 400. In particular, upper packing element 412 creates a sealing point and seals pressure from below the annular BOP 400. The lower packing element 420 creates another seal point and seals pressure from above the annular BOP 400. Accordingly, the upper and lower packing elements 412 and 420 will seal about a drill pipe 434 into a closed position. As a result, fewer annular BOPs may be required in a BOP stack, thereby reducing the overall height of the stack and saving costs.

In order to transition the annular BOP 400 from the closed position shown in FIG. 5 back to the open position shown in FIG. 4, fluid is pumped through an open chamber (not shown) to reverse the process. The fluid translates downward force to the piston 428, such that the piston allows the upper and lower packing elements 412 and 420 to radially expand to the open position. The annular BOP 400 can be cycled between the open and closed positions as necessary.

Figure 6:
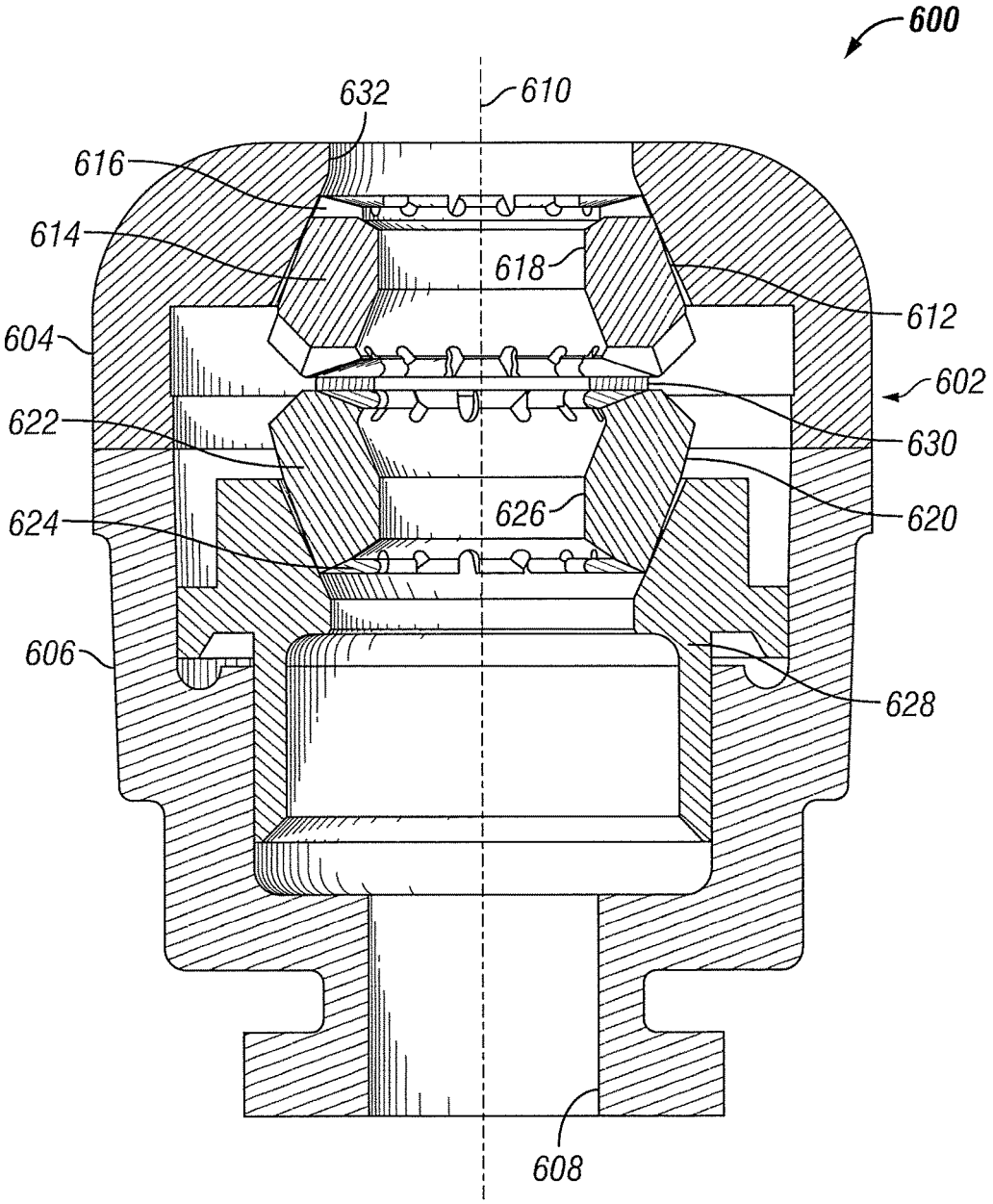
FIG. 6 shows a partial cross-sectional elevation view of an annular blowout preventer in an open position, in accordance with one or more embodiments.

FIG. 6 shows a partial cross-sectional elevation view of an annular blowout preventer 600 in an open position, in accordance with one or more embodiments. The annular BOP 600 could be included in a subsea BOP stack, such as BOP stack 200 illustrated in FIGS. 2 and 3. The annular BOP 600 comprises a housing 602 including an upper housing 604 and a lower housing 606. The housing 602 includes a vertical bore 608 extending therethrough and disposed about a longitudinal axis 610. An upper packing element 612 is disposed within the housing 602 about the longitudinal axis 610. The upper packing element 612 includes an annular elastomeric body 614 and a plurality of inserts 616. The inserts 616 are distributed radially about the longitudinal axis 610. The upper packing element 612 includes a bore 618 concentric with the vertical bore 608 of the annular BOP 600.

The housing 602 further includes a lower packing element 620 disposed about the longitudinal axis 610. An annular wear plate 630 is located between the upper and lower packing elements 612 and 620. The lower packing element 620 includes an annular elastomeric body 622 and a plurality of inserts 624. The inserts 624 are distributed radially about the longitudinal axis 610. The lower packing element 620 includes a bore 626 concentric with the vertical bore 608 of the annular BOP 600 and of a similar diameter to upper packer element bore 618.

The upper and lower plurality of inserts 616 and 624 can comprise any material or materials, such as metal and/or metal alloys. The elastomeric bodies 614 and 622 can comprise any elastomeric material or materials. The annular wear plate 630 can comprise any material or materials, such as metal and/or metal alloys. In the illustrated embodiment, packing elements 612 and 620 comprise conical geometries. However, other geometries are envisioned, as discussed above.

The annular BOP 600 upper and lower packing elements 612 and 620 are actuated by pumping a fluid into a close chamber (not shown) to apply pressure to a piston 628, thereby moving the piston 628 upward. The piston 628 has a complimentary conical geometry to that of the lower packing element 620. As the piston 628 moves upward, the piston 628 translates force directly to the lower packing element 620 and indirectly to annular wear plate 630 and upper packing element 612. The force translated to the lower packing element 620, annular wear plate 630, and upper packing element 612 from the piston 628 is directed upward toward an inner surface 632 of the annular BOP 600 housing 602, and inward toward the longitudinal axis 610 of the annular BOP 600.

Because the upper packing element 612 is retained against the inner surface 632 of the annular BOP 600 housing 602, the upper packing element 612, annular wear plate 630, and lower packing element 620 do not displace upward from the force translated by the piston 628. Rather, the upper and lower packing elements 612 and 620 push off annular wear plate 630 and displace inward from the translated force, which compresses the upper and lower packing elements 612 and 620 toward the longitudinal axis 610 of the annular BOP 600. As a result, the annular BOP 600 can be configured to a closed position to seal off a well without the presence of a pipe or other downhole equipment disposed within the annular BOP 600, i.e., sealing an open hole. In the event a drill pipe (as shown in FIG. 7) is located within the annular BOP 600, with sufficient radial compression, the upper and lower packing elements 612 and 620 will seal about the drill pipe into a closed position.

Figure 7:
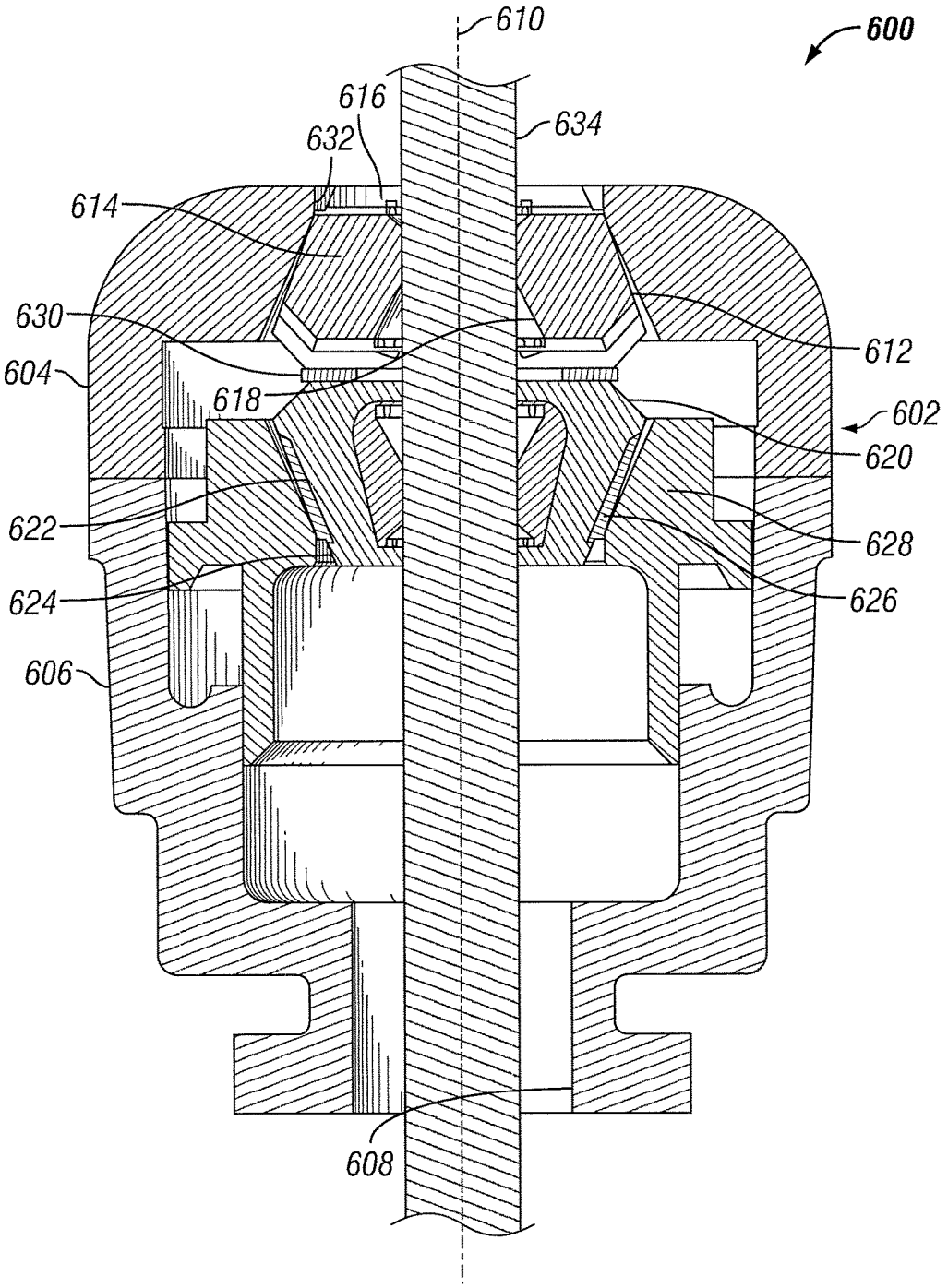
FIG. 7 shows a partial cross-sectional elevation view of the annular blowout preventer of FIG. 6 in a closed position, in accordance with one or more embodiments.

FIG. 7 shows a partial cross-sectional elevation view of the annular blowout preventer of FIG. 6 in a closed position, in accordance with one or more embodiments. In particular, the piston 628 in FIG. 7 has moved upward as discussed above. In doing so, the piston 628 has displaced upper and lower packing elements 612 and 620 toward the longitudinal axis 610 of the annular BOP 600, thereby allowing for bi-directional sealing functionality. That is, inclusion of upper and lower packing elements 612 and 620 provides for sealing pressure from above and below the annular BOP 600. In particular, upper packing element 612 creates a seal point and seals pressure from below the annular BOP 600. The lower packing element 620 creates another seal point and seals pressure from above the annular BOP 600. As shown in FIG. 7, a drill pipe 634 can be located within the annular BOP 600. Accordingly, with sufficient radial compression, the upper and lower packing elements 612 and 620 will seal about the drill pipe 634 into a closed position. As a result, fewer annular BOPs may be required in a BOP stack, thereby reducing the overall height of the stack and saving costs.

In order to transition the annular BOP 600 from the closed position shown in FIG. 7 back to the open position shown in FIG. 6, fluid is pumped through an open chamber (not shown) to reverse the process. The fluid translates downward force to the piston 628, such that the piston allows the upper and lower packing elements 612 and 620 to radially expand to the open position. The annular BOP 600 can be cycled between the open and closed positions as necessary.

Figure 8:
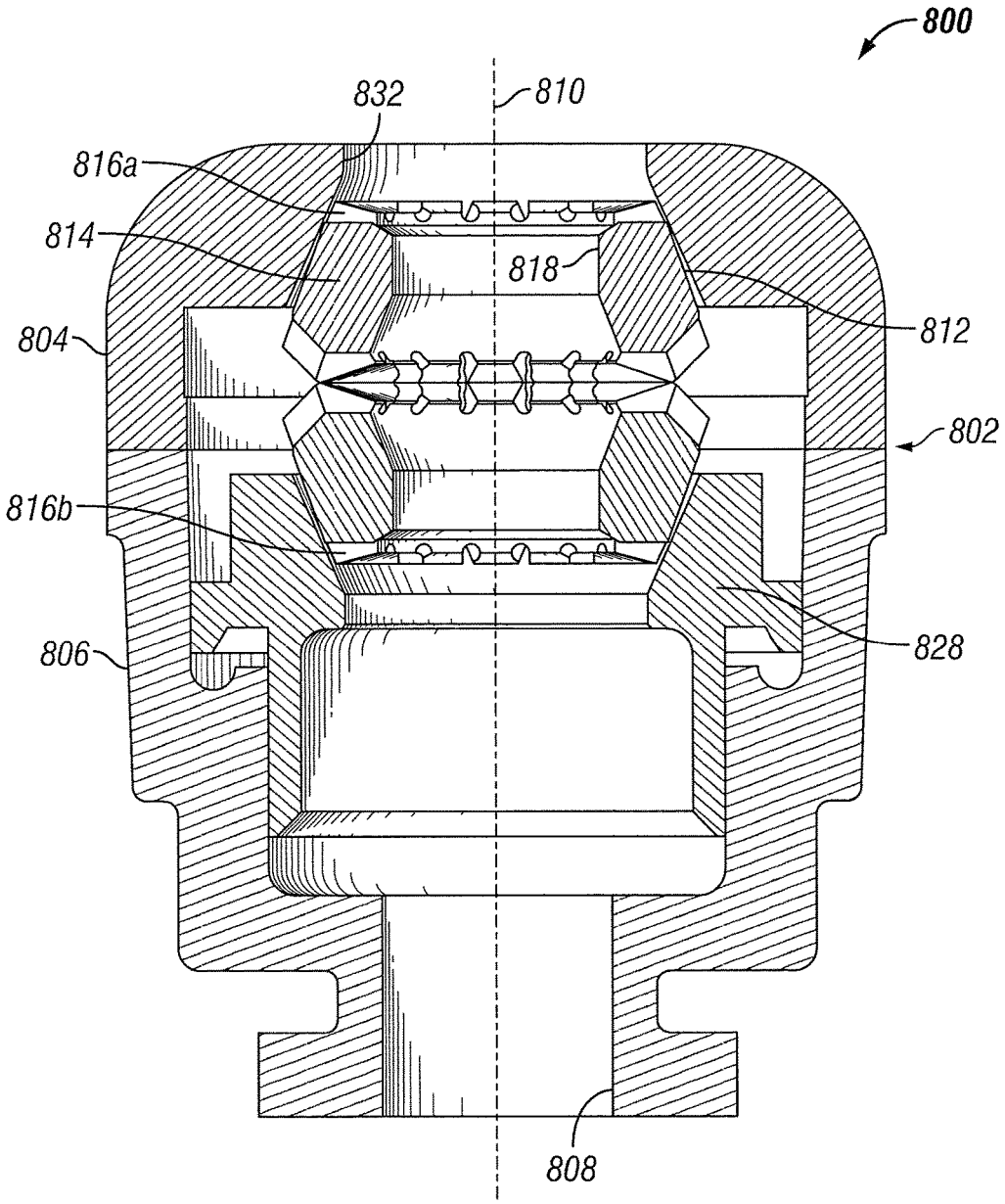
FIG. 8 shows a partial cross-sectional elevation view of an annular blowout preventer in an open position, in accordance with one or more embodiments.

FIG. 8 shows a partial cross-sectional elevation view of an annular blowout preventer 800 in an open position, in accordance with one or more embodiments. The annular BOP 800 could be included in a subsea BOP stack, such as BOP stack 200 illustrated in FIGS. 2 and 3. The annular BOP 800 comprises a housing 802 including an upper housing 804 and a lower housing 806. The housing 802 includes a vertical bore 808 extending therethrough and disposed about a longitudinal axis 810. A packing element 812 is disposed within the housing 802 about the longitudinal axis 810. The packing element 812 includes an annular elastomeric body 814, an upper plurality of inserts 816*a*, and a lower plurality of inserts 816*b*. The inserts 816*a* and 816*b* are distributed radially about the longitudinal axis 810. The packing element 812 includes a bore 818 concentric with the vertical bore 808 of the annular BOP 800.

The upper and lower plurality of inserts 816*a* and 816*b* can comprise any material or materials, such as metal and/or metal alloys. The elastomeric body 814 can comprise any elastomeric material or materials. In the illustrated embodiment, packing element 812 comprises a dual conical geometry. However, other geometries are envisioned, as discussed above.

The annular BOP 800 packing element 812 is actuated by pumping a fluid into a close chamber (not shown) to apply pressure to a piston 828, thereby moving the piston 828 upward. The piston 828 has a complimentary conical geometry to that of the lower plurality of inserts 816*b*. As the piston 828 moves upward, the piston 828 translates force directly to the packing element 812. The force translated to the packing element 812 from the piston 828 is directed upward toward an inner surface 832 of the annular BOP 800 housing 802, and inward toward the longitudinal axis 810 of the annular BOP 800.

Because the packing element 812 is retained against the inner surface 832 of the annular BOP 800 housing 802, the packing element 812 does not displace upward from the force translated by the piston 828. Rather, the packing element 812 is compressed as a result of the contact between the upper plurality of inserts 816*a* and the inner surface 832 and between the lower plurality of inserts 816*b* and the piston 828. As a result, the packing element 812 is compressed toward the longitudinal axis 810 of the annular BOP 800. For example, the packing element 812 may be configured to a closed position to seal off a well without the presence of a pipe or other downhole equipment disposed within the annular BOP 800, i.e., sealing an open hole. In the event a drill pipe (as shown in FIG. 9) is located within the annular BOP 800, with sufficient radial compression, the packing element 812 will seal about the drill pipe into a closed position.

Figure 9:
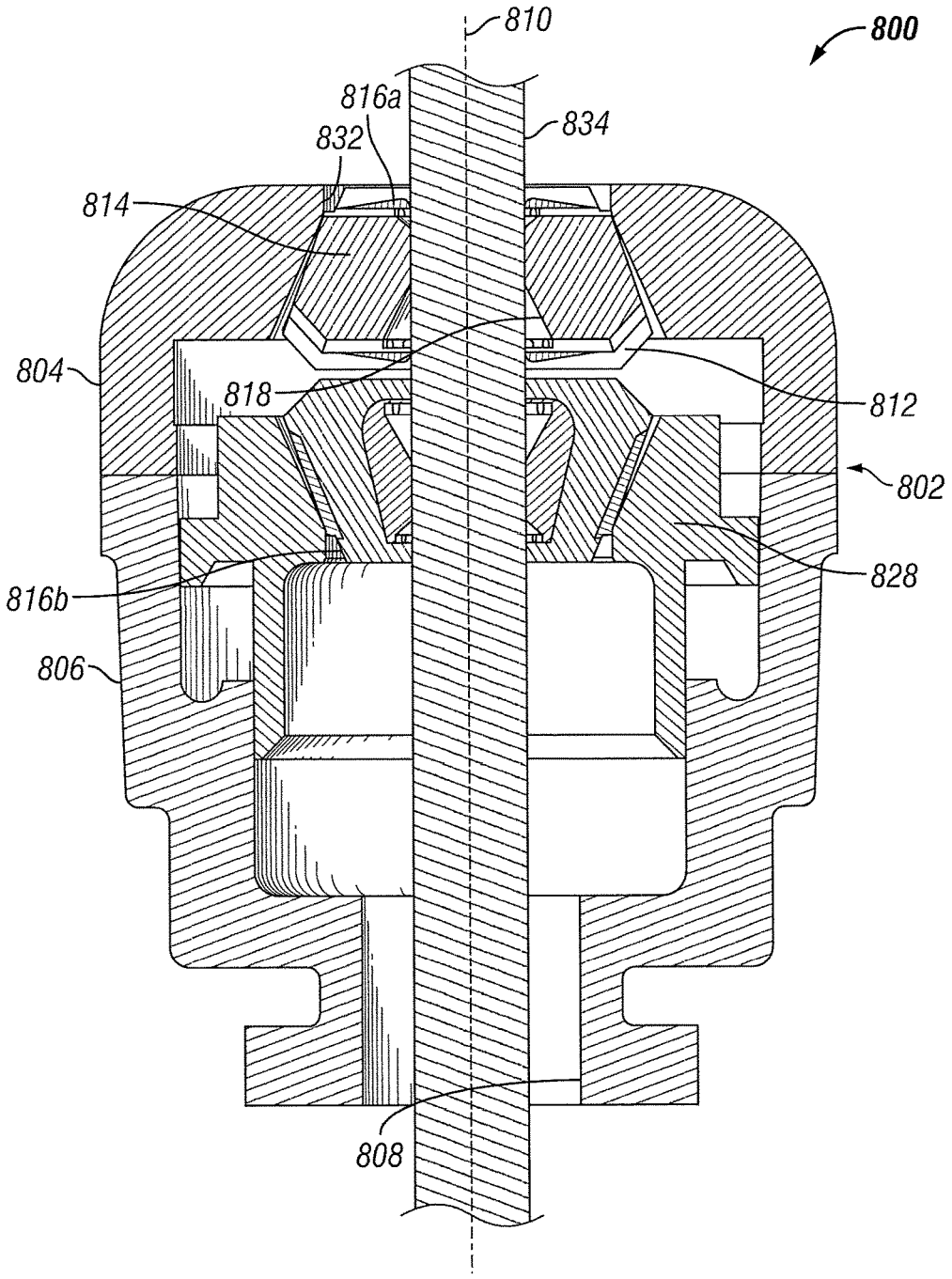
FIG. 9 shows a partial cross-sectional elevation view of the annular blowout preventer of FIG. 8 in a closed position, in accordance with one or more embodiments.

FIG. 9 shows a partial cross-sectional elevation view of the annular blowout preventer of FIG. 8 in a closed position, in accordance with one or more embodiments. In particular, the piston 828 in FIG. 9 has moved upward as discussed above. In doing so, the piston 828 has displaced the packing element 812 toward the longitudinal axis 810 of the annular BOP 800, thereby allowing for bi-directional sealing functionality. That is, inclusion of the upper and lower plurality of inserts 816*a* and 816*b* provides for multiple sealing points and seals pressure from above and below the annular BOP 800. When a drill pipe 834 is located within the annular BOP 800, the packing element 812 will seal about the drill pipe 834 into a closed position with sufficient radial compression.

In order to transition the annular BOP 800 from the closed position shown in FIG. 9 back to the open position shown in FIG. 8, fluid is pumped through an open chamber (not shown) to reverse the process. The fluid translates downward force to the piston 828, such that the piston allows the packing element 812 to radially expand to the open position. The annular BOP 800 can be cycled between the open and closed positions as necessary.

In embodiments, an annular BOP comprising upper and lower packing elements (such as annular BOPs depicted in FIGS. 4-7) or a single packing element (such as annular BOP depicted in FIGS. 8 and 9) can be moved between an open position and a closed position, with or without a downhole component disposed in the annular BOP, using a piston located above the packing element(s). To move to an open position, the piston is actuated to move downward, compressing the packing element(s) against an inner surface of the BOP housing on the lower portion of the BOP housing. To move to a closed position, the piston is displaced upward to move the packing element(s) toward a longitudinal axis of the BOP. With respect to FIGS. 4-9, one or more pistons may be used to move the packing element(s) and thus, configure the BOP into an open position or a closed position.

In addition to the embodiments described above, many examples of specific combinations are within the scope of the disclosure, some of which are detailed below:

Example 1

An annular blowout preventer ("BOP") apparatus, comprising:

a housing comprising a bore extending therethrough;

a first packing element located in the housing;

a second packing element located in the housing and spaced axially from the first packing element; and a piston configured to move the first and second packing elements radially with respect to the bore.

Example 2

The apparatus of Example 1, the first packing element comprising an annular elastomeric body and inserts embedded within the elastomeric body.

Example 3

The apparatus of Example 2, wherein the first packing element inserts and first packing element elastomeric body comprise different materials.

Example 4

The apparatus of Example 1, the second packing element comprising an annular elastomeric body and inserts embedded within the elastomeric body.

Example 5

The apparatus of Example 4, wherein the second packing element inserts and second packing element elastomeric body comprise different materials.

Example 6

The apparatus of Example 1, wherein the first and second packing elements are movable from an open position in which the first and second packing elements are radially withdrawn from the bore to a closed position in which the first and lower packing elements are radially moved into the bore.

Example 7

The apparatus of Example 6, wherein the first and second packing elements are configured to seal the bore above and below the housing in the closed position.

Example 8

The apparatus of Example 6, wherein the first and second packing elements are configured to seal about a device located within the bore in the closed position.

Example 9

The apparatus of Example 1, further comprising an annular plate located axially between the first and second packing elements.

Example 10

The apparatus of Example 1, wherein the piston is locatable in a piston recess located in the housing.

Example 11

The apparatus of Example 1, wherein the piston and the lower packing element have complimentary geometries.

Example 12

The apparatus of Example 1, wherein an inner surface of the housing and the upper packing element have complimentary geometries.

Example 13

The apparatus of Example 1, wherein the piston is configured to move the first and second packing elements simultaneously.

Example 14

An annular blowout preventer ("BOP") apparatus, comprising:

a housing comprising a bore extending therethrough;

a packing element located in the housing and movable from an open position radially withdrawn from the bore to a closed position radially within the bore;

a piston configured to move the packing element between the open and closed positions, and wherein the packing element is configured to form a first seal and a second seal in the bore in the closed position.

Example 15

The apparatus of Example 14, wherein the packing element comprises an annular elastomeric body and inserts embedded within the elastomeric body.

Example 16

The apparatus of Example 14, wherein the packing element is configured to seal about a device located within the vertical bore in the closed position.

Example 17

The apparatus of Example 14, wherein the piston is locatable in a piston recess located in the housing.

Example 18

The apparatus of Example 14, wherein an inner surface of the housing and an upper surface of the packing element have complimentary geometries.

Example 19

The apparatus of Example 14, wherein the piston and a lower surface of the packing element have complimentary geometries.

Example 20

The apparatus of Example 14, wherein the packing element inserts and packing element elastomeric body comprise different materials.

This discussion is directed to various embodiments of the present disclosure. The drawing figure is not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout this description and claims to refer to particular features or components. As one skilled in the art will appreciate, different persons may refer to the same feature or component by different names. This document does not intend to distinguish between components or features that differ in name but are the same structure or function. The drawing figure is not necessarily to scale. Certain features and components herein may be shown exaggerated in scale or in somewhat schematic form and some details of conventional elements may not be shown in interest of clarity and conciseness.

In this discussion and in the claims, the terms "including" and "comprising" are used in an open-ended fashion, and thus should be interpreted to mean "including, but not limited to . . . ."

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. An annular blowout preventer ("BOP") apparatus, comprising:

a housing comprising a bore extending therethrough;

a first packing element located in the housing, the first packing element comprising a first elastomeric body and a first plurality of inserts embedded within the first elastomeric body;

a second packing element located in the housing and spaced axially from the first packing element, the second packing element comprising a second elastomeric body and a second plurality of inserts embedded within the second elastomeric body, wherein the first plurality of inserts and the second plurality of inserts are physically separate from one another; and a piston configured to move the first and second packing elements radially with respect to the bore.

2. The apparatus of claim 1, wherein the first plurality of inserts and the first elastomeric body comprise different materials.

3. The apparatus of claim 1, wherein the second plurality of inserts and the second elastomeric body comprise different materials.

4. The apparatus of claim 1, wherein the first and second packing elements are movable from an open position in which the first and second packing elements are radially withdrawn from the bore to a closed position in which the first and lower packing elements are radially moved into the bore.

5. The apparatus of claim 4, wherein the first and second packing elements are configured to seal the bore above and below the housing in the closed position.

6. The apparatus of claim 4, wherein the first and second packing elements are configured to seal about a device located within the bore in the closed position.

7. The apparatus of claim 1, further comprising an annular plate located axially between the first and second packing elements.

8. The apparatus of claim 1, wherein the piston is locatable in a piston recess located in the housing.

9. The apparatus of claim 1, wherein the piston and the second packing element have complimentary geometries.

10. The apparatus of claim 1, wherein an inner surface of the housing and the first packing element have complimentary geometries.

11. The apparatus of claim 1, wherein the piston is configured to move the first and second packing elements simultaneously.

12. The apparatus of claim 1, wherein the piston is configured to contact the second packing element and not the first packing element as the piston moves the first and second packing elements radially with respect to the bore.

13. An annular blowout preventer ("BOP") apparatus comprising:

a housing comprising a bore extending therethrough;

a packing element comprising an elastomeric body, located in the housing, and movable from an open position radially withdrawn from the bore to a closed position radially within the bore;

a piston configured to move the packing element between the open and closed positions, wherein the elastomeric body of the packing element comprises two elastomeric bodies axially spaced from each other;

wherein the two elastomeric bodies comprise a first elastomeric body configured to form a first seal and a second elastomeric body configured to form a second seal axially spaced from each other against an object, comprising a tubular member and locatable in the bore, when in the closed position and;

a first plurality of inserts embedded within the first elastomeric body and a second plurality of inserts embedded within the second elastomeric body, and the first plurality of inserts are physically separate from the second plurality of inserts.

14. The apparatus of claim 13, wherein the elastomeric body comprises an annular elastomeric body and inserts embedded within the elastomeric body.

15. The apparatus of claim 14, wherein the inserts and the elastomeric body comprise different materials.

16. The apparatus of claim 13, wherein the piston is locatable in a piston recess located in the housing.

17. The apparatus of claim 13, wherein an inner surface of the housing and an upper surface of the packing element have complimentary geometries.

18. The apparatus of claim 13, wherein the piston and a lower surface of the packing element have complimentary geometries.

* * * * *